US005323751A

United States Patent [19]

Osanai et al.

[11] Patent Number: 5,323,751

[45] Date of Patent: Jun. 28, 1994

[54] DEVICE FOR CONTROLLING OPERATION OF FUEL EVAPORATIVE PURGE SYSTEM OF AN INTERNAL COMBUSTION ENGINE

[75] Inventors: Akinori Osanai, Susono; Takaaki Itou, Mishima; Yukio Kinugasa, Susono, all of Japan

[73] Assignee: Toyota Jidosha Kabushiki Kaisha, Toyota, Japan

[21] Appl. No.: 110,232

[22] Filed: Aug. 23, 1993

Related U.S. Application Data

[63] Continuation of Ser. No. 928,645, Aug. 13, 1992, abandoned, which is a continuation of Ser. No. 724,757, Jul. 2, 1991, abandoned.

[30] Foreign Application Priority Data

Jul. 13, 1990 [JP] Japan ..... 2-184084

[51] Int. Cl.[5] ..... F02M 37/04

[52] U.S. Cl. ..... 123/520; 123/198 D

[58] Field of Search ..... 123/520, 519, 518, 516, 123/521, 198 D

[56] References Cited

U.S. PATENT DOCUMENTS

| | | | |
|---|---|---|---|
| 4,326,489 | 4/1982 | Heitert | 123/520 |
| 4,641,623 | 2/1987 | Hamburg | 123/520 |
| 4,763,635 | 8/1988 | Ballhause | 123/520 |
| 4,809,667 | 3/1989 | Uranishi | 123/520 |
| 4,865,000 | 9/1989 | Yajima | 123/520 |
| 4,926,825 | 5/1990 | Ohtaka | 123/520 |
| 4,932,386 | 6/1990 | Uozumi | 123/521 |
| 4,953,514 | 9/1990 | Beicht | 123/521 |
| 4,986,070 | 1/1991 | Abe | 123/520 |
| 5,014,674 | 5/1991 | Takeda | 123/520 |
| 5,020,503 | 6/1991 | Kanasashi | 123/520 |

FOREIGN PATENT DOCUMENTS

| | | | |
|---|---|---|---|
| 57-86555 | 2/1982 | Japan . | |
| 56-143336 | 2/1982 | Japan . | |
| 60-159360 | 12/1985 | Japan . | |
| 0001857 | 1/1986 | Japan | 123/520 |
| 62-174557 | 7/1987 | Japan . | |
| 63-55357 | 3/1988 | Japan . | |
| 63-39787 | 8/1988 | Japan . | |
| 01-87886 | 7/1989 | Japan . | |
| 2-245441 | 10/1990 | Japan . | |

*Primary Examiner*—Carl S. Miller
*Attorney, Agent, or Firm*—Kenyon & Kenyon

[57] ABSTRACT

A device for controlling a fuel evaporative purge system having a solenoid valve arranged in a purge passage, comprises a unit for determining a maximum amount of fuel vapor to be purged, an air flow meter, a unit for calculating a maximum purging ratio of the maximum amount of fuel vapor to an amount of intake air, a unit for setting a purging ratio which is gradually varied during the purging process, and a unit for activating the solenoid valve. In the purging operation, the activating unit drives the valve at a duty-ratio identical to a ratio of the purging ratio to the maximum purging ratio.

9 Claims, 7 Drawing Sheets

1msec. ROUTINE
S1
INCREMENT T (T←T+1)
S2
T ≧ 100? (100 Duty Cycle)
Yes
No
S3
PGC ≧ 1 ?
Yes
No
S4
INCREMENT PGC (PGC←PGC+1)
S5
PGC ≧ 6
Yes
No
S6
PGC ≧ 156
Yes
No
S16
PURGING CONDITION SATISFIED ?
Yes
No
a

DEVICE FOR CONTROLLING OPERATION OF FUEL EVAPORATIVE PURGE SYSTEM OF AN INTERNAL COMBUSTION ENGINE

This application is a continuation of application Ser. No. 07/928,645, filed Aug. 13, 1992, now abandoned, which is a continuation of 07/724,757 filed on Jul. 2, 1991, now abandoned.

BACKGROUND OF THE INVENTION

1. Field of the Invention

The present invention relates to a device for controlling the operation of a fuel evaporative purge system of an internal combustion engine, and more particularly, to a device included in a system provided with a canister for absorbing and temporarily storing a fuel vapor, a purge passage communicating the canister with an intake passage, and a solenoid valve arranged in the purge passage.

In such a system, when the engine is operating under a predetermined condition, i.e., a purging condition, the device activates the solenoid valve to thereby communicate the canister with the intake passage, whereby the fuel vapor is separated from an absorbent contained in the canister and supplied to combustion chambers of the engine.

2. Description of the Related Art

Among conventional devices for controlling the operation of a fuel evaporative system of an internal combustion engine, Japanese Unexamined Patent Publication No. 62-174557 discloses a device provided with a solenoid valve which is arranged in a purge passage connecting a canister for absorbing fuel vapor with an intake passage for activating the valve at a duty cycle to thereby purge an appropriate amount of the fuel vapor corresponding to an actual driving condition (for example, engine load, engine speed) of the engine.

In the above device, if the current driving condition, which is in a driving range wherein the purging of the system is prohibited (for example, at a low engine load and low engine speed), is changed to a condition which is in a driving range wherein the purging operation can be carried out (for example, at a high engine load and high engine speed), the operation of solenoid valve is controlled so that a value of the duty ratio at which the valve is operated will be gradually increased at a constant rate until reaching a target value determined in accordance with the prevailing driving condition, to thus prevent an abrupt variation of the air-fuel ratio and thereby stabilize an output torque of the engine.

Since the above device employs a method of gradually increasing the duty ratio of the valve at a constant rate, to reach the target duty ratio at the beginning of the purging operation, if a vehicle equipped with the device is abruptly accelerated or decelerated during the process for attaining the target duty ratio, the amount of fuel vapor purged from the canister cannot be rapidly increased in response to abrupt changes of the amount of intake air or the engine load.

Therefore, for example, when such an abrupt change in the intake air amount occurs in an internal combustion engine having an air-fuel ratio feedback control system provided with an air-fuel ratio detecting sensor in an exhaust pipe, to thereby control the air-fuel ratio to a stoichiometric air-fuel ratio, as shown in FIG. 5, a feedback correction coefficient FAF will be changed over a wide range, because the amount of fuel vapor purged is not sufficient to supply a required amount of fuel in response to the change of the intake air amount.

Consequently, the air-fuel ratio of the above engine will be incorrect, and therefore, an output torque of the engine will become unstable.

SUMMARY OF THE INVENTION

An object of the present invention is to provide a device for controlling the operation of a fuel evaporative system, which device can inhibit an undesirably great change of the feedback correction coefficient FAF, as much as possible, to thereby lessen the variation of an air-fuel ratio, even if an abrupt change in the driving conditions occurs while carrying out the purging operation.

Therefore, according to the present invention, there is provided a device for controlling the operation of a fuel evaporative purge system of an internal combustion engine provided with a canister for absorbing fuel vapor, a purge passage communicating the canister with an intake passage, and a solenoid valve arranged in said purge passage to activate the valve at a duty cycle to thereby purge the fuel vapor in an appropriate amount corresponding to an actual intake air flow when said engine is operating under a predetermined condition, said device comprising:

means for determining a maximum amount of fuel vapor to be purged into said intake passage and corresponding to an actual driving condition;

means for detecting an amount of intake air aspirated into said engine;

means for calculating a maximum purging ratio of the maximum amount of fuel vapor to the amount of intake air;

means for setting a purging ratio in such a manner that the ratio changes gradually to the maximum purging ratio when said predetermined condition is satisfied and accordingly, the operation of the fuel evaporative purge system is begun; and means for activating the solenoid valve at a duty-ratio identical to a ratio of the purging ratio to the maximum purging ratio.

In the conventional device, the duty ratio is gradually increased at a constant rate, when purging the fuel vapor. Conversely, the device according to the present invention changes the ratio of the amount of purged fuel vapor to the amount of intake air, i.e., the purging ratio.

In addition, according to the invention, the duty ratio of the solenoid valve is set as the ratio of the purging ratio to the maximum purging ratio, and therefore, when an abrupt change in the amount of intake air occurs during the purging operation, the duty ratio of the valve is also changed by a change of the maximum purging ratio, which is calculated in accordance with the amount of intake air. Namely, according to the present invention, by changing of amount of fuel vapor to be purged regardless of changes in the amount of intake air, variations of feedback correction coefficient FAF can be reduced as much as possible.

The present invention will be more fully understood from the description of the preferred embodiment thereof set forth below, together with the accompanying drawings.

DESCRIPTION OF THE PREFERRED EMBODIMENTS

Figure 1:
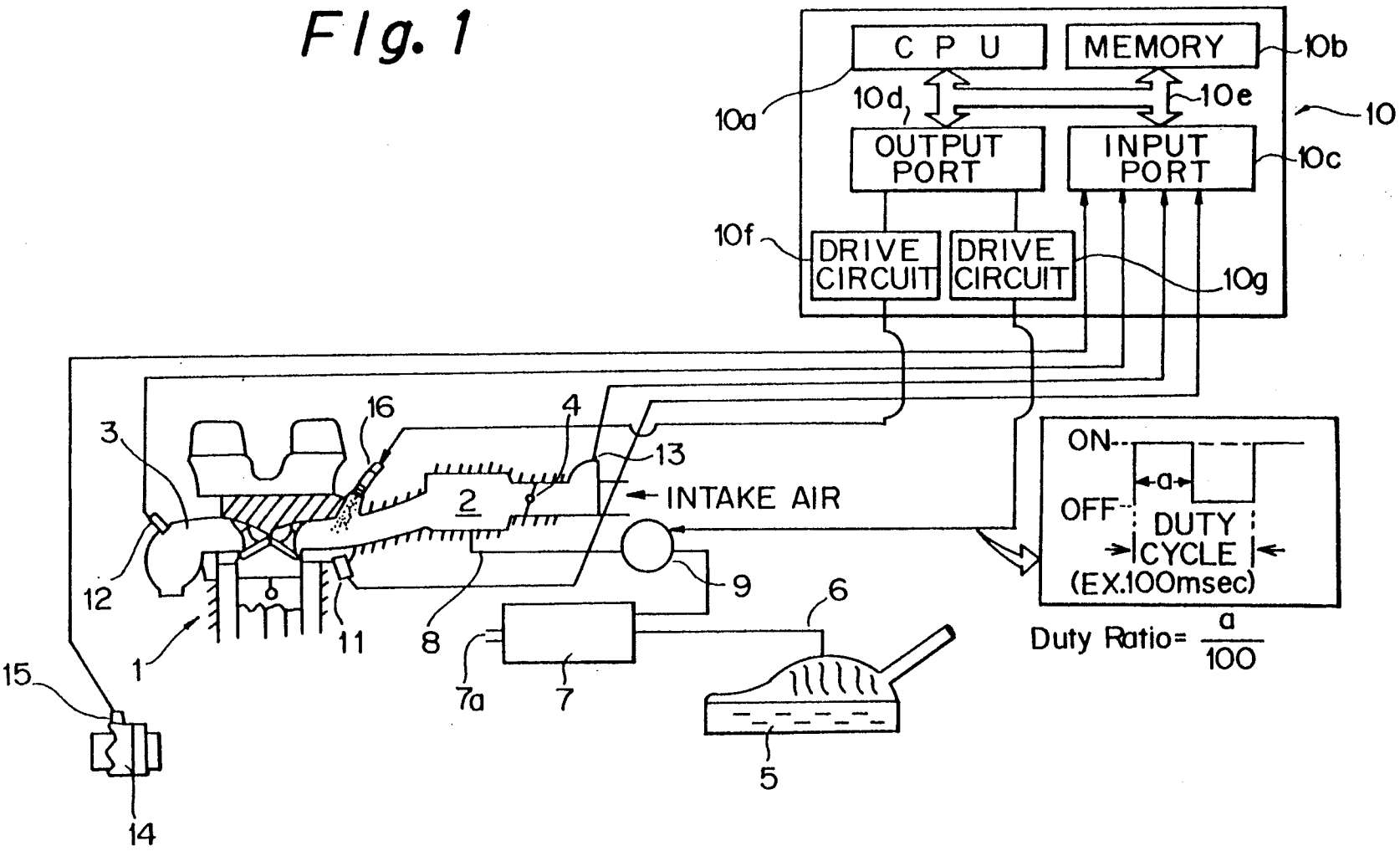
FIG. 1 is a schematic view of a device for controlling the operation of a fuel evaporative purge system according to an embodiment of the invention.

FIG. 1 shows a fuel evaporative purge system of an embodiment according to the present invention.

In FIG. 1, reference numeral 1 designates an engine body, 2 an intake passage through which intake air is introduced into the engine body 1, 3 an exhaust passage through which exhaust gas from the engine body 1 is discharged, and 4 a throttle valve provided in the intake passage 2 for controlling an amount of the intake air supplied to the engine body 1.

Reference numeral 5 designates a fuel tank for storing fuel, and fuel vapor evaporated therefrom is fed to a canister 7 through a vapor passage 6. The canister 7 contains an absorbent (not shown) such as activated carbon, and the fuel vapor is absorbed by the absorbent and temporarily held thereby.

The canister 7 is communicated with the intake passage 2 at a part thereof downstream of the throttle valve 4 via a purge passage 8, and a solenoid valve 9 is arranged in the purge passage 8 and controlled by a control circuit 10, and is opened to allow a communication between the canister 7 and the intake passage 2 when an "ON" signal is received.

The control circuit 10 is constructed by a microcomputer which comprises a microprocessing unit (CPU) 10*a*, a memory 10*b* such as a ROM (read only memory) and a RAM (random access memory), an input port 10*c*, an output port 10*d*, and a bus 10*e* interconnecting these components.

The input port 10*c* receives various signals which indicate the current driving conditions. These signals comprise a signal indicating a coolant temperature from a coolant temperature sensor 11, a signal indicating an air-fuel ratio from an oxygen concentration detecting sensor (hereinafter referred to as an $O_2$ sensor) 12 positioned in the exhaust passage 3, a signal indicating an amount of intake air from an air flow meter 13, a signal indicating an engine speed from a crank angle sensor 15 mounted on a distributor 14, and so on.

In operation, the CPU 10*a* of the control circuit 10 calculates an actual fuel injection time TAU corresponding to the current driving condition detected by these sensors 11, 12, 15 and the air flow meter 13, and the output port 10*d* then outputs a drive signal to a fuel injector 16 mounted at the intake passage 2, through a drive circuit 10*f* in the control circuit 10, to thereby inject an amount of fuel corresponding to the calculated TAU.

Furthermore, when the current engine driving condition is under a predetermined driving condition (hereinafter referred to as "the purging condition"), for example, when the engine is driven at a coolant temperature of over 80° C. and under the feedback control to the stoichiometric air-fuel ratio, the output port 10*d* outputs an "ON" signal with a duty ratio (described in detail hereinafter) to the solenoid valve 9 through a drive circuit 10*g*, to communicate the canister 7 with the intake passage 2. Accordingly, a negative pressure, i.e., the intake vacuum, is introduced into the canister 7 through the purge passage 8, and thus the fuel vapor held in the canister 7 is separated therefrom and purged to the intake passage 2, together with fresh air introduced through an air inlet 7*a* of the canister 7.

Figures 2, 2A, 2B, 2C:
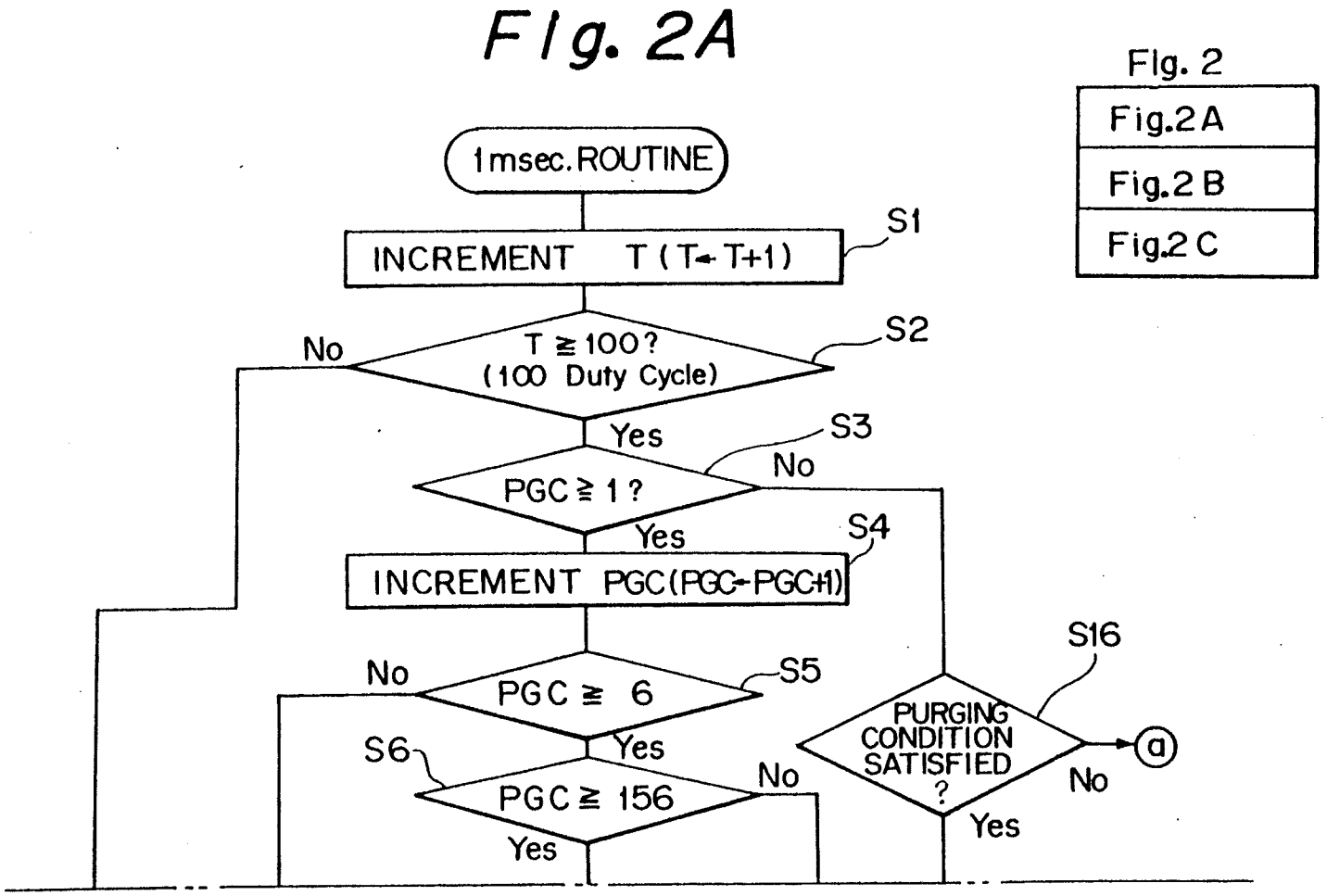
FIGS. 2A–C are flow charts of the routine carried out by a control circuit shown in FIG. 1, according to the present invention.
Figure 2B:
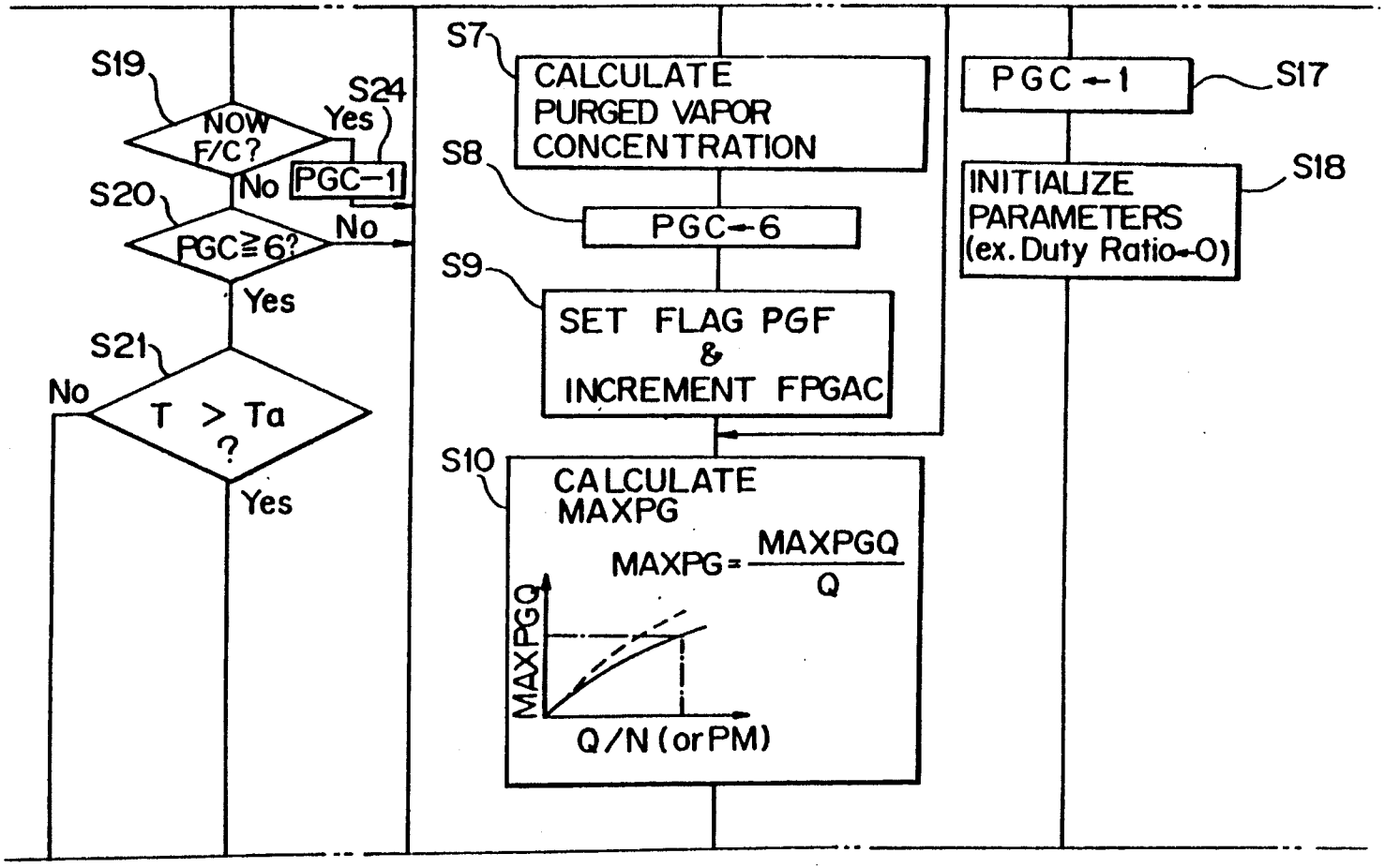
Figure 2C:
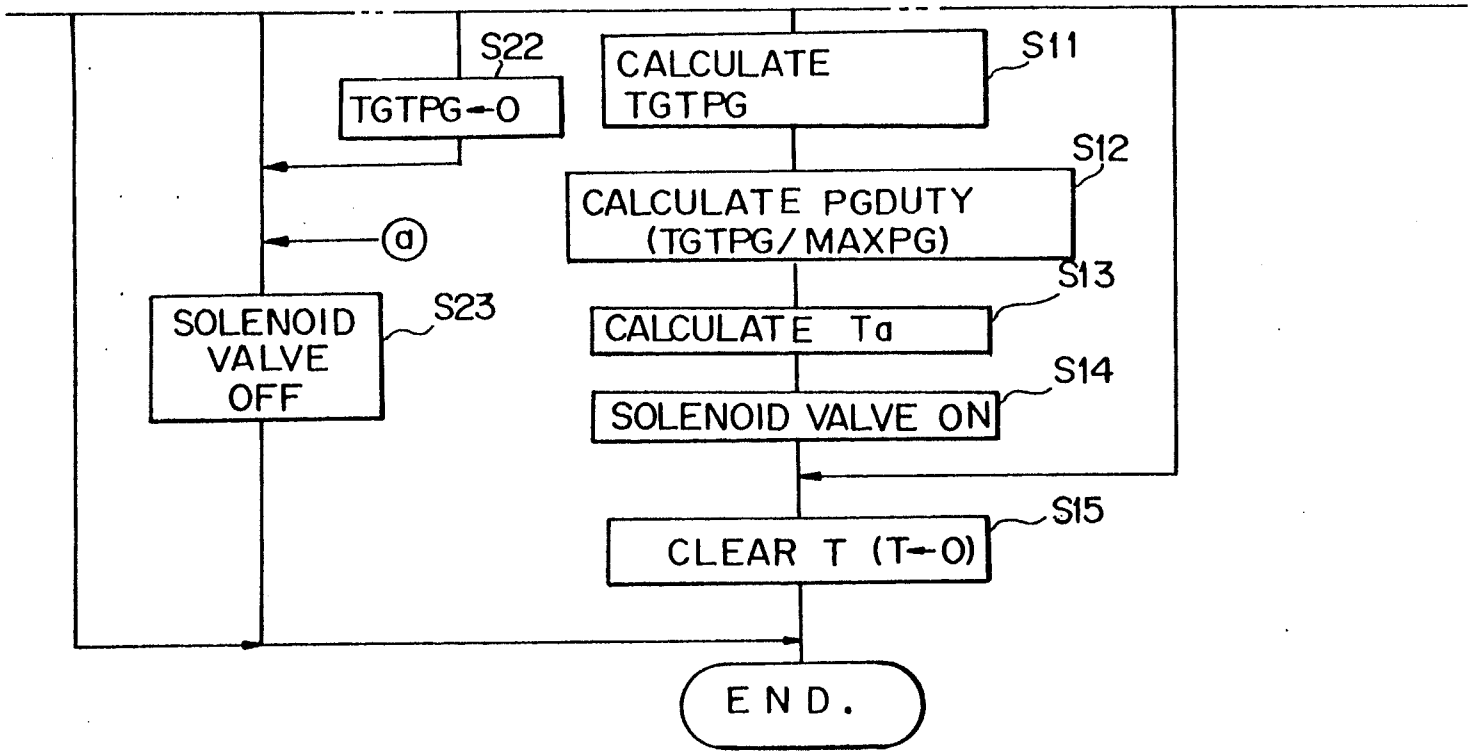

FIG. 2 illustrates a flow chart for executing the control of an operation of the solenoid valve 9. The routine illustrated in FIG. 2 is processed by sequential interruptions executed at 1 msec. intervals.

As shown in the figure, at step S1 a timer counter T, a value of which is incremented by one at every routine cycle, is counted up and the routine goes to step S2.

At step S2, it is determined whether or not the present time is a starting or ending point of a duty cycle of the solenoid valve 9; for example, if one duty cycle of the valve 9 is set to be 100 msec. as shown in a circle in FIG. 1, it is determined whether or not a current value of the counter T is more than 100.

If the result at step S2 is YES, i.e., $T \geqq 100$, the routine goes to step S3 and it is determined whether or not a value of a purging counter PGC is more than 1. Note, a value of this purging counter PGC is counted up when the present driving condition of the engine matches the above-mentioned purging condition. Namely, at step S3 it is determined whether the purging condition has been established by the time at which the previous routine was executed.

Then, if the result is NO, the routine goes to step S16 and it is determined whether or not the present driving condition detected by the coolant temperature sensor 11, the air flow meter 13, and the crank angle sensor 15, etc., matches the purging condition.

Therefore, if the result at step S16 is YES, the routine goes to step S17, at which a value of the above-mentioned purging counter PGC is first set to 1, and the process then goes to step S18.

At step S18, before starting the purging operation of the system, various parameters necessary for controlling the operation are initialized (for example, the duty ratio of the solenoid valve 9 is set to zero).

Conversely, if the result at step S16 is NO, i.e., when the present driving condition does not match the purging condition, the process goes to step S23 (see mark "a"), at which a process for stopping the output of an "ON" signal to the valve 9 is executed to thereby close the purge passage 8, and the routine is then ended.

Returning to step S3, if the result is YES, because the value of the purging counter PGC is more than 1, the routine goes to step S4 and the process of counting up the value of PGC by one is executed.

Note, in a fuel injection system, when the vehicle is decelerated, the supply of fuel by the fuel injector into the intake passage normally will be prohibited, to lower the fuel consumption, and a system operation such as a fuel-cut operation will be carried out. Therefore, at the start of the air-fuel ratio feedback control, just after the fuel-cut operation is finished, the air-fuel ratio is temporarily increased to a lean mixture, and thus feedback control is not stable.

Therefore, at step S5, it is determined whether or not the present driving condition, which is included in the purging condition, is under the stabilized air-fuel ratio feedback control after finishing the fuel-cut operation. In this embodiment, the result can be changed by determining whether or not the time elapsed since the driving condition matched the purging condition is longer than a predetermined time (for example, 0.6 sec.). Namely, at step S5, for example, it is determined whether or not the value of counter PGC is more than 6, which corresponds to a determination of whether or not the elapsed time is more than 0.6 sec., since the value of PGC in this embodiment is counted up at every 100 msec. Note, in other embodiments, the time by which it is determined whether or not the present driving condition is under the stabilized air-fuel ratio feedback control may be changed to another value, as necessary.

In the result at step S5 is NO, i.e., when the present driving condition is not under the stabilized air-fuel ratio feedback control, the routine goes to step S22 and a purging ratio (an amount of purged fuel vapor/an amount of intake air) is initialized to zero, and then goes to the afore-mentioned step S23.

Conversely, if the result at step S5 is YES, i.e., the present driving condition is under the stabilized air-fuel ratio feedback control, the routine goes to step S6 and then to step S7, at which the process for calculating a concentration of the purged fuel vapor, which corresponds to a deviation of the air-fuel ratio from the present purging ratio and which will be used in a routine for calculating an actual injection time described hereinafter, is executed at predetermined intervals (for example, 15 sec.) during the purging.

Namely, at step S6 it is determined whether or not the count of the counter PGC is more than 156, which corresponds to a determination of whether or not the elapsed time of 15 sec. has passed since the purging operation was started. Then, if the result at step S6 is YES, the routine goes to step S7 and the concentration of the purged fuel vapor is calculated, and thus at step S8, the value of PGC (more than 156) is set to 6, for the calculating of the next concentration of the purged fuel vapor.

Next, at step S9, the processes for setting a purge learning flag PGF and counting up a purge learning counter FPGAC (initial value: 0), both of which will be also used in the routine for calculating the actual injection time, are executed and the routine goes to step S10.

Returning to step S6, if the result is NO, for example, if the count at the counter PGC is 6 and thus it is time to execute the purging operation, the routine goes to step S10 and bypasses steps S7, S8, and S9.

Then at and after step S10, the processes constituting a feature of the present invention are carried out. Namely, at step S10, by using a map exhibiting the relationship between a maximum amount of the fuel vapor to be purged and an engine load Q/N or PM (Q: an amount of the intake air, N: an engine speed, PM: an intake vacuum), which map may be obtained in advance by experiments with an empty canister and a full-opened solenoid valve 9, the actual maximum amount MAXPGQ corresponding to the present engine load Q/N calculated from output signals of the air flow meter 13 and the crank angle sensor 15 is obtained. Furthermore, at step S10, a ratio of the above MAXPGQ to the amount of intake air Q, i.e., a maximum purging ratio MAXPG, is finally calculated.

Next, at step S11, a target purging ratio TGTPG at every duty cycle (i.e., a target ratio of the amount of fuel vapor to the amount of intake air) is calculated from the following equation.

$$TGTPG = PGA \cdot PGdc \cdot 1/10$$

Figure 3:
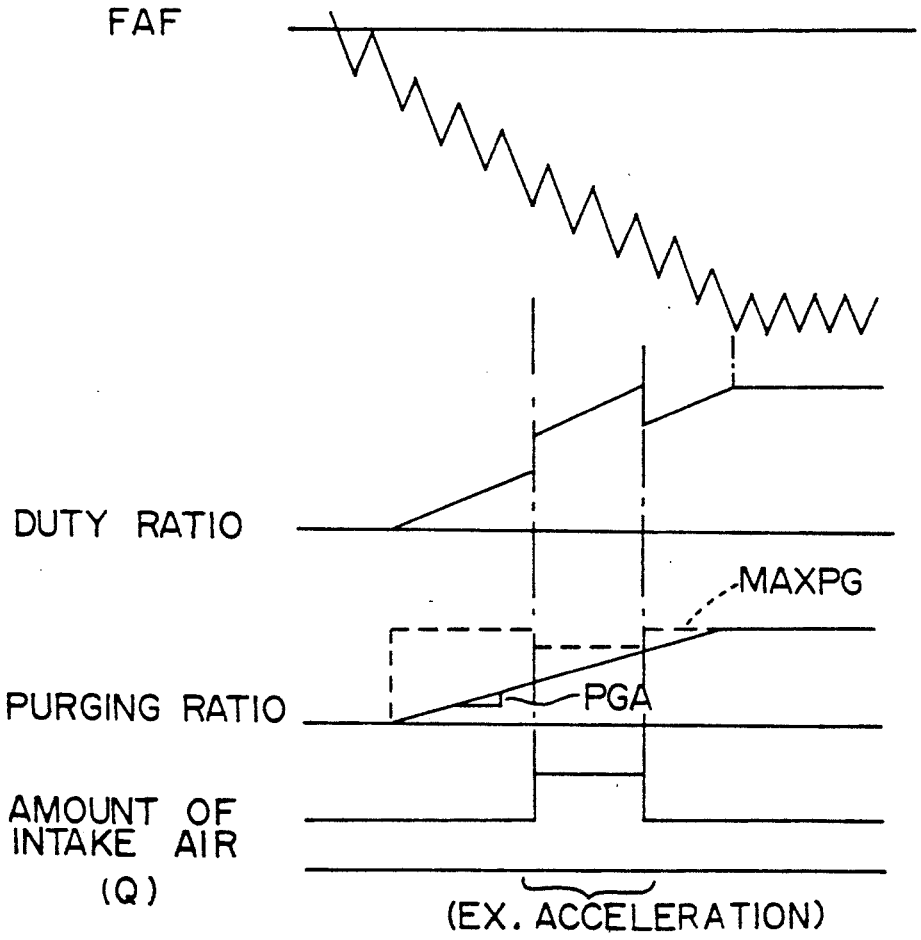
FIG. 3 shows various changes of FAF, a duty ratio, a purging ratio and an amount of intake air, according to the present invention.

In this equation, PGA is a predetermined change rate of the purging ratio, corresponding to an inclination angle of the purging ratio shown in FIG. 3, and may be a positive integer such as 1, 2 or 3 (1/10%/sec). PGdc is a number of a counter to be counted up at every duty cycle (e.g., 100 msec.) when a value of FAF under the air-fuel ratio feedback control is within a predetermined range, and is to be counted down at every duty cycle when the value of FAF is beyond the range.

Next, at step S12, using the maximum purging ratio MAXPG and the purging ratio TGTPG as obtained above, a process for calculating an opening rate at every duty cycle (e.g., 100 msec.), i.e., a duty ratio PGDUTY (TGTPG/MAXPG), is executed. Then at step S13, an opening period Ta of the solenoid valve 9 is calculated from the calculated duty ratio PGDUTY and the predetermined duty cycle (e.g., Ta=PGDUTY·100 msec), and the routine goes to step S14 where the control circuit 10 outputs an "ON" signal to open the valve 9 for the period Ta.

Then, at step S15, a value of the timer counter T is reset to zero, and the routine is ended.

Note, if the result at step S2 is NO, i.e., when it is neither the starting nor ending point of the duty cycle, the routine goes to step S19 and it is determined whether or not the present driving condition is the fuel-cut operation under which the air-fuel ratio feedback control is not executed. If the result is NO, the routine goes to step S20 and it is determined whether or not the present driving condition is under the stabilized air-fuel ratio feedback control.

Alternatively, if the result at step S19 is YES, the routine goes to step S24 and a value of the purging counter PGC is set to 1, for the subsequent purging operation, and the routine then goes to step S22. Similarly, if the result at step S20 is NO, the routine goes to step S22 as the time for opening the valve 9 has not elapsed.

Then at step S22, the purging ratio is initialized to zero, and the routine then goes to step S23 to thereby close the valve 9.

Conversely, if the result at both steps S19 and S20 is YES, i.e., the valve 9 has already started to open before the present routine is executed, the process goes to step S21 and it is determined whether or not the value of the counter timer T is higher than the value corresponding to the opening period Ta calculated at step S13.

Therefore, if the result at step S21 is YES, the routine goes to step S23 and the valve 9 is closed. Conversely, if the result at step S21 is NO, the routine bypasses step S23 and the valve 9 is kept open, and thus the routine is ended.

FIG. 3 illustrates examples of changes of the FAF and the duty ratio, etc., when an acceleration occurs during the process by which the actual purging ratio is increased to the maximum purging ratio MAXPG, under the purging operation of the present control device, according to the flow chart shown in FIG. 2.

As shown in FIG. 3, the maximum purging ratio MAXPG, changes in which are shown by a dashed line, is determined in response to the driving condition, such as the amount of the intake air. According to the flow chart of FIG. 3, since the actual purging ratio is changed to be gradually increased to the maximum purging ratio MAXPG, the duty ratio identical to the ratio of the purging ratio to the maximum purging ratio also is changed, e.g., to the purging ratio under a constant amount of intake air.

Therefore, when such an increase in the intake air as shown in FIG. 3, i.e., an acceleration occurs, during the process whereby the purging ratio is increased, the maximum purging ratio calculated at that point is conversely decreased, and thus the calculated duty ratio is increased.

Figure 5:
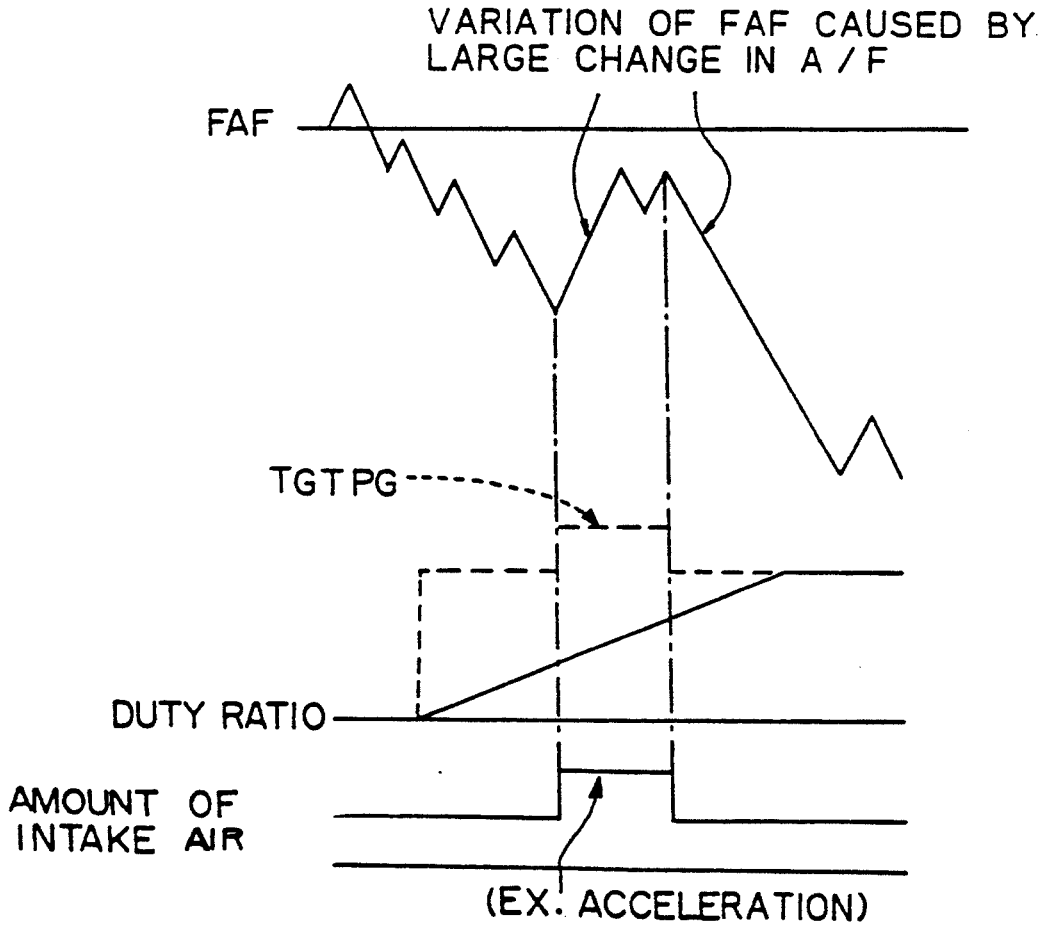
Fig. 5 (PRIOR ART)

Namely, according to the above embodiment of the present invention, it is not a change in the feedback correction coefficient FAF as shown in FIG. 5 but a change in the amount of fuel vapor purged from the canister that copes with the change in the amount of intake air, and therefore, a large change in the FAF can be controlled as much as possible to thereby inhibit variations of the air-fuel ratio.

Figure 4:
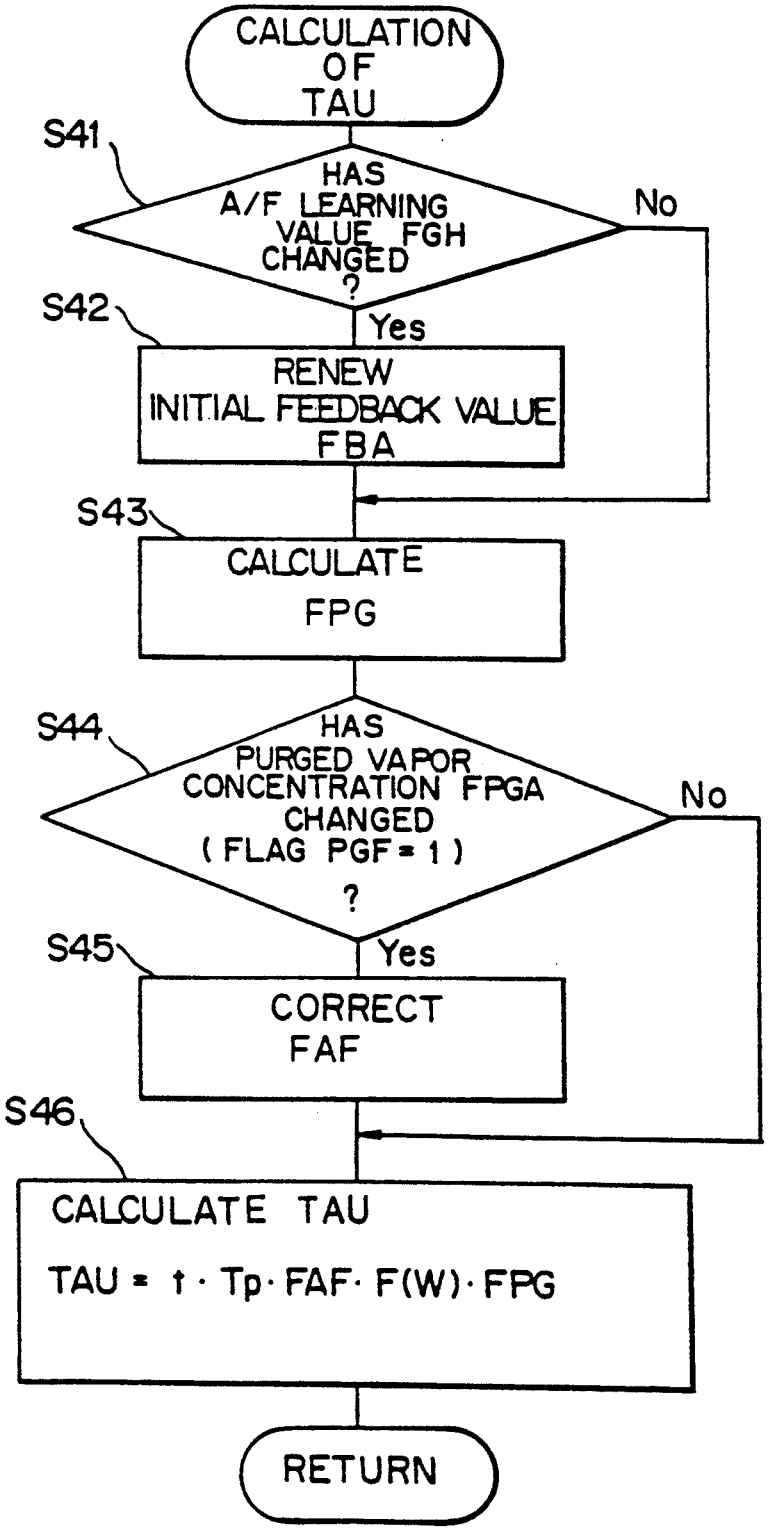
FIG. 4 is a flow chart for calculating an actual injection time, taking into account a purge control according to the present invention; and, FIG. 5 is a diagram similar to that shown in FIG. 3, showing various changes of FAF, a duty ratio and an amount of intake air, according to the conventional device.

FIG. 4 shows a flow chart for calculating the actual injection time TAU when the process shown by the flow chart in FIG. 2 is carried out. This routine is processed at a predetermined crankangle.

First, at step S41, it is determined whether or not a learning value FGH of the air-fuel ratio as a base is different from that of the previous routine. If the result is YES, the routine goes to step S42 and an initial feedback value FBA, which has been memorized as an average of FAF values just before the purging operation begins, is renewed by a change of the learning value FGH of the air-fuel ratio.

Conversely, if the result at step S41 is NO, i.e., the purging is not carried out and thus the learning value FGH is not changed (the purging flag PGF in FIG. 2 is zero), the routine bypasses step S42 and goes to step S43.

Then, at step S43, an air-fuel ratio correction value FPG changed by the purging operation is calculated, and at step S44, it is determined whether or not the concentration of purged fuel vapor FPGA is renewed at this time, i.e., whether or not the purging flag PGF is set to 1. Then, if the concentration of purged fuel vapor FPGA at this time differs from that of the previous routine, i.e., if the judgement at step S44 is YES, the routine goes to step S45 and the feedback correction coefficient FAF is corrected in accordance with changes in the concentration of purged fuel vapor FPGA.

Note, if the result at step S44 is NO, the routine bypasses step S45 and goes to step S46.

Finally, at step S46, using the obtained FAF and FPG, the actual injection time TAU of the fuel injector 16 is calculated from the following equation, and the routine then ended.

$$TAU = t \cdot Tp \cdot FAF \cdot F(W) \cdot FPG$$

where t·Tp: basic injection time determined by the driving condition

FAF: feedback correction coefficient

F(W): fuel increasing coefficient due to an acceleration, coolant temperature, etc.

FPG: air-fuel ratio correction value

In this equation, the basic injection time t·Tp is calculated from the engine speed and the amount of intake air fed to the engine. The feedback correction coefficient FAF is controlled based on the output signal of the O2 sensor 12, so that an air-fuel ratio becomes equal to the stoichiometric air-fuel ratio.

As described above, according to the present invention, by calculating the duty ratio of the solenoid valve as a base of the maximum purging ratio determined from the driving condition, it is possible to limit a change of the FAF to within a predetermined range, to thereby inhibit variations of the air-fuel ratio, even if an abrupt change occurs in the amount of intake air due to an abrupt acceleration or deceleration during the purging.

Further, according to the above embodiment, by detecting a concentration of fuel vapor purged at appropriate intervals, as shown at step S7 of FIG. 2, it is possible to correct a purged air-fuel ratio corresponding to the concentration of fuel vapor purged and the purging ratio at that time.

Finally, although an embodiment of the present invention has been described herein with reference to the attached drawings, many modifications and changes may be made thereto by those skilled in this art without departing from the scope of the invention.

We claim:

1. A device for controlling operations of a fuel evaporative purge system of an internal combustion engine provided with a canister for absorbing fuel vapor, a purge passage communicating said canister with an intake passage of the engine at a part thereof downstream of a throttle valve, and a solenoid valve arranged in said purge passage, wherein said device activates said solenoid valve in successive duty cycles to purge the fuel vapor by an appropriate value corresponding to an actual intake air flow when said engine is operating within a predetermined purging range, said device comprising:

means for determining and updating a maximum amount of fuel vapor to be purged into said intake passage corresponding to an actual current driving condition, which maximum amount is attained when said solenoid valve is fully opened;

means for detecting a current amount of intake air aspirated into said engine;

means for calculating an updated maximum purging ratio of an updated value of said maximum amount of fuel vapor to said current amount of intake air;

means for setting a target purging ratio, when the engine operating condition is in said predetermined purging range, at a value that changes gradually; and means for activating said solenoid valve during each duty cycle at a duty ratio identical to a ratio of said target purging ratio to said updated maximum purging ratio.

2. A device according to claim 1, wherein said means for determining and updating a maximum amount of fuel vapor to be purged comprises an experimentally obtained map which exhibits relationships between said maximum amount of fuel vapor and a driving condition of said engine.

3. A device according to claim 2, wherein said driving condition comprises engine load.

4. A device according to claim 1, wherein said means for detecting a current amount of intake air comprises an air flow meter.

5. A device according to claim 4, wherein said predetermined purging range within which said fuel evaporative system purging control device is activated comprises engine operating conditions above a predetermined coolant temperature of said engine under a stable air-fuel ration feed back control.

6. A device according to claim 5, wherein said engine if further provided with a coolant temperature sensor, and said predetermined coolant temperature is 80° C.

7. A device according to claim 1, wherein said maximum purging ratio is calculated at every duty cycle of said solenoid valve and wherein said target purging ratio is also set at every duty cycle of said valve.

8. A device according to claim 7, further comprising means for calculating, during a purging operation of said device, a concentration of purged fuel vapor at predetermined intervals longer than said duty cycle.

9. A device according to claim 1 wherein said means for setting a target purging ratio comprises means for setting said target purging ratio at a value that is proportional to the time elapsed since the start of a purging operation.

* * * * *

UNITED STATES PATENT AND TRADEMARK OFFICE

CERTIFICATE OF CORRECTION

PATENT NO. : 5,323,751

DATED : June 28, 1994

INVENTOR(S) : Akinori OSANAI, et al.

It is certified that error appears in the above-identified patent and that said Letters Patent is hereby corrected as shown below:

Column 5, line 19, change "In" to --If--.

Column 9, line 3, change "ration" to --ratio--.

Column 9, line 5, change "if" to --is--.

Signed and Sealed this

Twenty-second Day of November, 1994

*Attest:*

Bruce Lehman

BRUCE LEHMAN

*Attesting Officer*

*Commissioner of Patents and Trademarks*